US008882614B2

(12) United States Patent
Kropff et al.

(10) Patent No.: US 8,882,614 B2
(45) Date of Patent: Nov. 11, 2014

(54) PITCHING RUBBER

(75) Inventors: Chad Kropff, Roanoke, VA (US); Catherine Kropff, Roanoke, VA (US)

(73) Assignee: Bulldog Field Equipment, LLC, Roanoke, VA (US)

( * ) Notice: Subject to any disclaimer, the term of this patent is extended or adjusted under 35 U.S.C. 154(b) by 22 days.

(21) Appl. No.: 13/336,065

(22) Filed: Dec. 23, 2011

(65) Prior Publication Data

US 2012/0115653 A1 May 10, 2012

Related U.S. Application Data

(63) Continuation-in-part of application No. 13/167,653, filed on Jun. 23, 2011, now abandoned.

(60) Provisional application No. 61/357,829, filed on Jun. 23, 2010.

(51) Int. Cl.
*A63B 71/00* (2006.01)
*A63B 69/00* (2006.01)

(52) U.S. Cl.
CPC ..... *A63B 69/0002* (2013.01); *A63B 2069/0006* (2013.01)
USPC ..... 473/497

(58) Field of Classification Search
CPC ..... A63B 69/0002; A63B 69/00; A63B 2069/0006; A63B 2069/0004; A63B 2069/0002; A63B 2243/0004; A63B 2243/0008
USPC ..... 473/497, 499, 500, 501, 452, 415
See application file for complete search history.

(56) References Cited

U.S. PATENT DOCUMENTS

| | | | | | |
|---|---|---|---|---|---|
| 2,662,768 | A | * | 12/1953 | Madsen | 473/497 |
| 2,662,769 | A | * | 12/1953 | Madsen | 473/497 |
| 4,306,718 | A | | 12/1981 | Goeders | |
| 4,561,653 | A | | 12/1985 | Wright | |
| 4,591,154 | A | | 5/1986 | Santarone | |
| 4,666,155 | A | | 5/1987 | Stille | |
| 4,749,223 | A | | 6/1988 | Goeders | |
| 4,850,596 | A | * | 7/1989 | Olund | 273/408 |
| 5,058,889 | A | | 10/1991 | Burton | |
| 5,188,357 | A | | 2/1993 | Barnum | |

(Continued)

OTHER PUBLICATIONS

Beacon Athletics, Bulldog Field Equipment Pitching Rubber http://beaconathletics.com/store/permanent-four-sided/bulldog-field-equipment-pitching-rubber/.*

(Continued)

*Primary Examiner* — Mitra Aryanpour
(74) *Attorney, Agent, or Firm* — New River Valley IP Law, PC; Michele L. Mayberry

(57) ABSTRACT

The present invention is directed to pitching rubbers for baseball. More particularly, the invention relates to a four-sided, solid pitching rubber which provides an all-in-one durable construction with improved performance characteristics. Included in embodiments is a pitching rubber with a solid rubber body having a hollow core lengthwise through a rectangular block, wherein the hollow core has a width or diameter of about 50% or less of block width, and wherein the rubber has a Shore A hardness of about 75+/−5, a tensile strength ranging from about 8-12 MPA, and an elongation at break of about 300-600%. Pitching rubbers according to embodiments of the invention are capable of resisting packing and tamping weight without deformation of the rubber body.

4 Claims, 4 Drawing Sheets

(56) References Cited

U.S. PATENT DOCUMENTS

| | | | | |
|---|---|---|---|---|
| 5,213,323 | A | 5/1993 | Novinsky | |
| 5,624,112 | A | 4/1997 | Hummel et al. | |
| 5,707,305 | A | 1/1998 | Goeders et al. | |
| 5,769,745 | A | 6/1998 | Bartoli | |
| 5,827,140 | A | 10/1998 | Bartoli | |
| 5,919,103 | A | 7/1999 | Bartoli | |
| 6,616,556 | B1 * | 9/2003 | Osmudsen | 473/452 |
| 6,843,739 | B2 | 1/2005 | Putnam | |
| 7,344,459 | B2 | 3/2008 | Bykowsky | |
| 7,621,831 | B2 | 11/2009 | Roberts | |
| 2003/0220161 | A1 | 11/2003 | Putnam | |
| 2006/0100042 | A1 | 5/2006 | Bykowsky | |
| 2007/0117660 | A1 | 5/2007 | Roberts | |
| 2007/0298915 | A1 | 12/2007 | Goeders | |
| 2009/0270206 | A1 | 10/2009 | Massaro | |
| 2009/0305824 | A1 | 12/2009 | Sanders | |
| 2010/0248868 | A1 | 9/2010 | Massaro | |
| 2011/0319205 | A1 | 12/2011 | Kropff et al. | |

OTHER PUBLICATIONS

Mykin Inc., Rubber Hardness Chart http://mykin.com/rubber-hardness-chart.*

Lulusoso.com, Polyurethane Rubber Rod http://sell.lulusoso.com/selling-leads/551044/Polyurethane-Rubber-Rod.html.*

Regupol Anti Stumble Edging/EPDM http://www.regupol.com.au/au/products/sports-leisure/__impact-protection-for-playgrounds/regupol-anti-stumble-edging/regupol-anti-stumble-edging-product-details.php.*

Glogal Sources—Rubber Brick Manufacturer—EPDM Rubber Brick with Rubber Grains and Old Tyre Grains, Safety Rubber Surfacing http://www.globalsources.com/gsol/I/Sports-flooring/p/sm/1059416396.htm.*

Clwyd Computers LTD—The Special Rubber Compounders—Polymer Types—EPDM—Ethylene Propylene Diene Rubber http://www.clwydcompounders.com/material-selection/polymer-profiles/polymer-profiles-EPDM.asp.*

Eriks Rubber Tehnology—EPDM 75-compund 559306 black—Technical Data Sheet—2006 http://rubbertechnology.info/en/datasheets/rubber-mouldings/ERIKS%20-%20EPDM%2075-compound%20559306%20black.pdf.*

DelTech Control, LLC—Technical Data Sheet—EPDM , Nov. 2004 http://www.deltechcontrols.com/seat_material_ds.pdf.*

Tomark Sports—Multisport Equipment—Spring 2009—www.tomark.com, p. 92, Baseball/Softball Pitching Rubbers—4-way pitching rubbers.

* cited by examiner

PITCHING RUBBER

CROSS-REFERENCE TO RELATED APPLICATIONS

This application is a Continuation in Part application of U.S. Non-Provisional patent application Ser. No. 13/167,653, filed on Jun. 23, 2011 now abandoned, which relies on the disclosure of and claims priority to and the benefit of the filing date of U.S. Provisional Patent Application No. 61/357,829, filed on Jun. 23, 2010, the disclosures of which are hereby incorporated by reference herein in their entireties.

BACKGROUND OF THE INVENTION

1. Field of the Invention

The present invention relates to a pitching rubber capable of resisting deformation during use and an overall configuration and composition that imparts strength to the pitching rubber. More particularly, included in embodiments of the invention is a pitching rubber which provides an all-in-one durable construction with improved performance characteristics over existing pitching rubbers.

2. Description of Related Art

Properly laid out and constructed baseball fields are paramount to the game. Baseball and softball are played on fields having a playing surface comprising both turf and exposed soil or "skinned" areas. Successful maintenance programs for such ball fields thus include highly detailed maintenance of the skinned areas as well as the turf. Due to diversity among infield soils, however, maintenance programs are not universal. As such, because the composition of the skinned portions of the field vary greatly from field to field, maintenance of the field in accordance with regulations for a particular type of ball game is complex.

Although the basic layout of a ball field for playing softball, major league baseball, minor league baseball, little league, pony league, or Babe Ruth league type games is relatively similar (very generally involving four bases and a pitching mound), regulations for each type of game specify particular dimensions for the placement of the bases, pitching mound, and sub-parts of the pitching mound or pitching area.

Routinely, an area of the field, which is particularly difficult to maintain according to regulations is the pitcher's mound. For major league baseball, the pitcher's mound "clay" has a diameter of 18 feet. Within the pitcher's mound is a pitching rubber or toe plate, which is disposed at an offset position within the 18-foot circle, that is 10 feet from the front (toward home plate) and 8 feet from the back of the circle. The dimensions of a standard pitching rubber are 24 inches long and 6 inches wide. Additionally, the distance from the pitching rubber to home plate must be 60 feet 6 inches. At the time of installing or replacing a pitching rubber, its placement must be precise in order to meet regulations for play.

The top of the pitching "mound" is actually a flat or plateau. This surface is 5 feet in diameter. The top of the plateau is 10 inches above the surface level of home plate. A field level is often used to ensure accuracy of the height of the mound. Building a pitcher's mound is an art and a science. With so many regulation parameters, it is not difficult to recognize that formation and maintenance of the pitcher's mound is one of the most common aspects for errors in preparing a baseball field.

Just as the relative placement of the pitcher's plate, pitcher's mound, home plate, and bases is critical, so is the composition of the soil used for the skinned portions of the field. Even further, the soil composition of the infield is selectively different from the composition of the earth surrounding and comprising the pitcher's mound. Indeed, a mix of materials is often used to build the pitcher's landing area. In particular, a significant concentration of clay is required to provide the necessary stability and durability of this play area due to the increased traffic it receives as compared with other non-turf portions of the field. For example, a composition comprising 40% sand, 20% silt, and 40% clay is often recommended, but can vary greatly from field to field.

The pitching rubber and area of the field in which it is located is one of the most difficult portions of the field and maintain in accordance with regulations. In accordance with the rules of the game, the pitcher must be in contact with the pitching rubber while throwing the baseball or softball. Therefore, the pitching rubber is subjected to a high degree of wear and tear, requiring frequent replacement. Further, for relatively thin pitching rubbers and because there is only a very limited surface against which the soles and spikes of the pitcher's shoes can engage during the pitching motion, soil in front of the pitching rubber may become displaced during a game and from game to game. A typical problem of commonly used pitching rubbers is that they buckle in the center due to a lack of strength and support from the surrounding earth making their replacement necessary.

Existing pitching rubbers include those that are rigidly secured to blocks of wood embedded in the mound area. Oftentimes, the pitching rubber is rigidly mounted in place by nailing the same to the wood blocks. In U.S. Pat. No. 5,919,103, a relatively thin pitching rubber is supported by a thin wood or metal platform which in turn is further supported by elongated members extending a length into the earth. However, the volume below the pitching rubber being the ground is of a different composition than the rubber and does not have the strength or resistance to deformation that a solid rubber pitching rubber would have to be able to withstand the normal wear and tear associated with the game over an extended period of time. Disadvantages of these types of pitching rubbers include that they may loosen after use and cause their placement within the pitcher's mound to fall outside of the regulation specifications, due to the combination of their rigidity and lack of a substantial depth of solid rubber material extending into the ground.

Various attempts have been made in the prior art to ameliorate some of the noted disadvantages. In U.S. Pat. No. 4,591,154, a pitching rubber is disclosed which is secured to the top of a hollow box intended to be filled with cement, rocks, or soil and inserted in the ground. Even with a cement filling, the product still fails to provide a long lasting solution. In such arrangement, the box embedded in the ground to which the pitching rubber is attached does not have the needed tensile strength, elongation, resilience, and compression characteristics to withstand wear and tear during maintenance or use.

Other pitching rubbers are hollow rubber cylinders with a block shape exterior and a cylindrical inner diameter. Such assemblies claim to provide the capability of rotating the block after the pitching rubber on the exposed surface wears out. This type of pitching rubber is constructed to be used up to four times. However, because the pitching rubber is not solid and does not have a density capable of resisting deformation, the pitching rubber will bow or buckle on one side leaving the other three pitching rubbers damaged as well and thus unusable. Further, because the hollow pitching rubber does not have a substantial front, back, and bottom support surface area supported by a sufficiently dense interior, tamping of the surrounding ground in which it is place will lead to further buckling of the pitching rubber. Recognizing this deficiency, such products have recently been offered with inserts to fill the void or support the interior structure within the pitching rubber. The inserts, however, are made aluminum or PVC tubes which do not have the same physical characteristics as the pitching rubber in which they are placed. In embodiments where the tubing is filled with material, the same problem is noted in that the filling material, whether clay or foam, is not of the same composition. These arrangements that are either not solid and/or do not provide a uniform density throughout the product continue to provide pitching rubber assemblies which are not satisfactorily stable and require more frequent maintenance attention. Accordingly, in order to achieve a hollow-core pitching rubber that is sufficiently strong, either a change in the configuration is needed (moving from hollow core to solid core, smaller hollow core, or semi-solid core), or a change in rubber material to complement the particular configuration is needed, or both.

With at least 70+ home games played in the major and minor leagues each season, and the need for groundskeepers to maintain the pitching mound to almost perfection, maintenance can be time consuming, laborious, and costly. Thus, there remains a need for an improved pitching rubber which is capable of withstanding more wear and tear and is easy to manufacture, install and replace.

SUMMARY OF THE INVENTION

Embodiments of the present invention provide an improved pitching rubber, and more particularly a four sided, solid pitching rubber which provides an all-in-one durable construction with improved performance characteristics.

Particular embodiments of the invention include a pitching rubber with a hollow-core, a solid cube shape, or a body with voids on one or more of the elongated ends. Pitching rubber embodiments of the invention are characterized by having a density capable of resisting deformation and an overall configuration that imparts strength to the pitching rubber.

One mode of operation responsible for the inventive pitching rubber's success is that the weight of maintaining the pitcher's mound by packing and tamping that is done by the grounds staff at least once a day if not twice a day is evenly distributed throughout the solid cubed pitching rubber. Current pitching rubbers with the open-air core do not evenly distribute the packing and tamping weight which causes the pitching rubber to bow and buckle. Once the current pitching rubber models bow and buckle, they cannot be rotated even though that is what is advertised for each of the current pitching rubbers on the market. Embodiments of the invention, in contrast, can comprise an open-air core, which is smaller in diameter or internal width than that of existing pitching rubbers, in combination with a rubber material that is more dense and has other physical properties that impart strength, durability, and resilience into the overall product. Alternatively, the pitching rubber embodiments according to the invention can comprise a solid rubber cube, which also resists deformation and allows groundskeepers to rotate the pitching rubber throughout the season in order to maximize use and minimize costs. The invented pitching rubber can be rotated for use of all four sides with these designs.

The invention solves the problem of durability and achieving maximum use of pitching rubbers or toe-plates. Embodiments of the pitching rubber according to the invention can be made with a solid pour of rubber with no hollow interior.

An embodiment of the present invention provides for an improved pitching rubber comprising a four sided, solid block structure with carved out ends that promote stability of the pitching rubber when inserted in the ground.

Another embodiment of the present invention provides for an improved pitching rubber capable of resisting buckling. Such embodiments preferably comprise a hollow core with a diameter (otherwise referred to as a width) that is half the length or less of the width of one end. Further preferred is a pitching rubber with a solid rubber body having a hollow core lengthwise through a rectangular block, wherein the hollow core has a width or diameter of about 50% or less of block width. For example, for a 6×6×24 inch pitching rubber, the hollow core can be 3 in. or less in diameter/width. Additionally, the pitching rubber can comprise a rubber material that renders the overall pitching rubber capable of resisting deformation even with a hollow core. This allows for longer use of the pitching rubber and decreased costs and hassles associated with frequent replacement.

Yet another embodiment of the present invention provides an all-in-one method of making an improved pitching rubber comprising: creating a solid mold, filling the mold with block material, checking evenness of the fill, checking that the fill material is level on each of the four sides, allowing the material to cool, painting each of the sides and optionally testing each of the sides to provide an improved pitching rubber. In embodiments, the mold can be configured such that a pitching rubber with solid rubber material is formed with a hollow core or voids in the elongated end(s) of the pitching rubber. Processes of preparing pitching rubbers can include any of direct molding, transfer molding, injection molding, extrusion molding, or pan vulcanization to name a few.

The features of novelty and various other advantages that characterize the invention are pointed out with particularity in the claims forming a part hereof. However, for a better understanding of the invention, its advantages, and the objects obtained by its use, reference should be made to the drawings that form a further part hereof, and to the accompanying descriptive matter, in that there is illustrated and described a preferred embodiment of the invention. The features and advantages of the present invention will be apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DETAILED DESCRIPTION OF PREFERRED EMBODIMENTS

Figure 1:
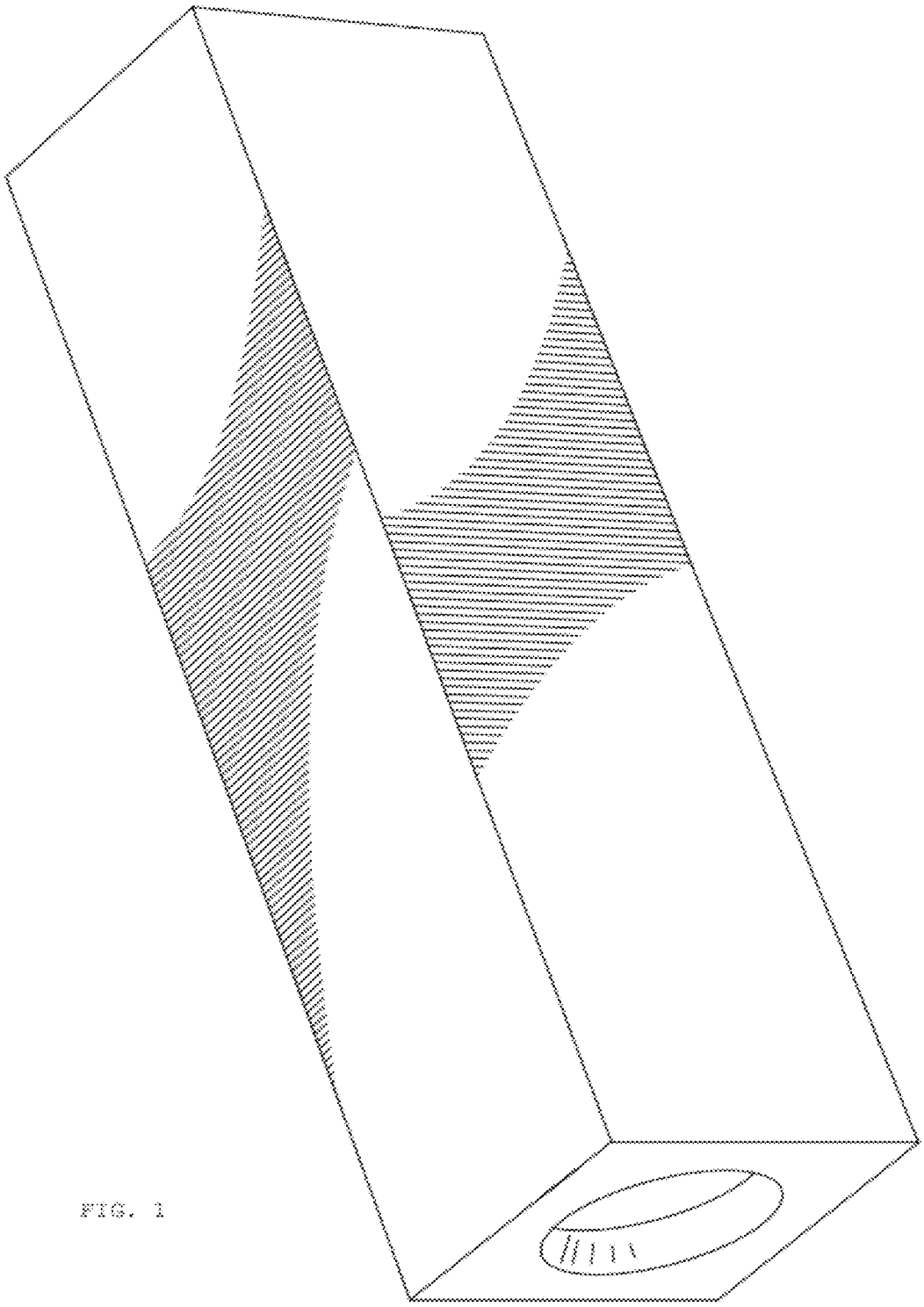
FIG. 1 represents a side perspective view of a pitching rubber constructed in accordance with the present invention.

In accordance with embodiments of the present invention, the present invention relates to an improved pitching rubber. More particularly embodiments of the invention include a four sided, solid, semi-solid, or hollow core pitching rubber which provides an all-in-one durable construction with improved performance characteristics.

Preferably included in embodiments of the invention are pitching rubbers with a substantial front, back, and bottom support surface area supported by a sufficiently dense interior. In particular, embodiments include a pitching rubber with four elongated side surfaces measuring 6×24 inches with each side surface having an area of about 144 $in^2$. In the case of a youth sized pitching rubber, the four elongated side surfaces can measure 4×18 inches (area of about 72 $in^2$. The sufficiently dense interior can be provided by having solid rubber throughout the pitching rubber, having hollow ends with an otherwise solid core, or solid rubber material surrounding a hollow interior, which is shaped, sized, and of a rubber composition which allows for strength against buckling during use and/or over time from multiple uses.

For example, the diameter or width of the hollow interior of pitching rubber embodiments of the invention can be from about 15% to about 75% of the length of one end. This includes pitching rubbers with an interior diameter of about 20% to about 60%, or from about 25% to about 50%, or from about 30% to about 40%, or even about 35% of the length of one end of the pitching rubber. Although referred to as a "diameter," the cross-sectional shape of the interior hollow does not have to be circular, and square, rectangular, triangular, or any polygonal shape will suffice. In preferred embodiments, the diameter of the hollow interior can be from about 1 in. to about 4.5 in. for a 6×6 in. end, and preferably 3 in. Likewise, the diameter of the hollow interior can be from about 1 in. to about 2.5 in. for a 4×4 in. end.

Another embodiment of the present invention provides for an improved pitching rubber capable of resisting buckling. Such embodiments can include a pitching rubber with a hollow interior, wherein the sides of the pitching rubber resist buckling due to the strength of the rubber material and the amount of rubber material between an elongated face of the pitching rubber and the hollow interior. Preferably, the material is EPDM 75 (a sulfur cured terpolymer of ethylene, propylene and diene), with a Shore A hardness of 75+/−5, a minimum tensile strength of about 8-12 MPA, such as about 10 MPA, and an ultimate elongation (ASTM D412) of 450%, and the hollow interior has a diameter of 3 in. for a 6×6×24 in. pitching rubber. These dimensions (and any of the dimensions provided in this specification) are provided merely for guidance to one of skill in the art who would know how to make appropriate adjustments for obtaining a different sized pitching rubber, such as a youth sized pitching rubber. Resistance to buckling can be accomplished by a combination of using high-strength rubber, an appropriate sized hollow interior, and an appropriate sized face. This allows for longer use of the pitching rubber and decreased costs and hassles associated with frequent replacement.

Especially preferred are pitching rubber embodiments which combine one or more of the features described in this specification. For example, a preferred pitching rubber includes one having one or more of the following features: a solid core, hollow core, hollow ends with a solid core, side surface area of about 72-144 $in^2$, total surface area of about 648 $in^2$ to about 900 $in^2$, density in the range of about 0.04-0.06 $lb/in^3$, diameter of hollow interior ranging from about 40-55% of the length of an end, and a weight of about 25-60 lbs. Specific embodiments may include one or more of the following characteristics: side surface area of about 144 $in^2$, total surface area of about 860 $in^2$, density of about 0.04-0.06 $lb/in^3$, diameter of hollow interior of about 50% of the length of an end of the pitching rubber, and with an A3 commercial tolerance. These specifications are provided in order to describe a typical 6×6×24 in. adult pitching rubber, however, it is within the skill of the art to scale up or down these dimensions for a different application, such as for a youth pitching rubber.

Pitching rubbers of the invention can include any combination of characteristics described in this specification, including those relating to size, configuration, and characteristics of the particular rubber material used.

One of the many potential advantages of the pitching rubbers described in the present invention, only some of which are discussed herein, is that the pitching rubbers have an all-in-one construction making them easier to manufacture and install or replace. The cost of construction may also be decreased. Another advantage of the present embodiments includes the pitching rubbers having the appropriate characteristics to afford them a longer life and a decreased need for replacement. In preferred embodiments, the pitching rubbers comprise a solid rubber material allowing them to resist bulking. Most pitching rubbers used have an open-air core that does not allow for even distribution of the packing and tamping weight thereby causing the bulking discussed above. The present invention may have an open-air core, so long as the dimensions of the product in combination with the strength of the rubber material used work together to provide a pitching rubber that resists deformation or buckling during use. Thus, the term "solid" as used in this specification can include strong hollow core products as well as semi-hollow products, such as hollowed-out ends and can refer to the portion of rubber material making up the pitching rubber rather than the overall configuration of the pitching rubber. The present invention has a solid cubed center allowing for even distribution of the packing and tamping weight and thereby preventing bulking at the center and maximizing its use. Another advantage of the present invention may include the ability of groundskeepers to rotate the pitching rubber easily in order to further maximize use and limit unnecessary costs.

In certain embodiments, the present invention relates to a four sided, solid block pitching rubber structure that may be used for any major or minor league baseball and softball game. In some embodiments, the solid pitching rubber will have dimensions of about 6 inches in height by 6 inches in width by 24 inches in length. In other embodiments, for example in youth and little leagues, the solid pitching rubber may have dimensions of about 4 inches in height by 4 inches in width by 18 inches in length. The dimensions just provided refer to the outer surface of the pitching rubber. One of ordinary skill in the art, with the benefit of this disclosure, would know the appropriate dimensions to use for the pitching rubber depending on the type of use.

Included in embodiments is a pitching rubber comprising: a solid rubber body with four rectangular sides and two elongated ends; having a surface area of about 648 $in^2$ to about 744 $in^2$; and having a density ranging from about 0.04 to about 0.06 pounds per cubic inch. A preferred pitching rubber further has a void in each of the elongated ends, which voids together comprise a volume of less than 15% of the volume of the solid rubber body. Pitching rubbers according to embodiments of the invention are capable of resisting packing and tamping weight without deformation of the rubber body. Such embodiments have a smaller surface area than existing pitching rubbers, and in particular when compared to hollow core pitching rubbers. When referring to overall surface area what is meant in the context of this specification is the surface area of the rubber portion of the assembly. The overall surface area is one factor that helps contribute to less deformation, buckling, and bowing of the pitching rubber when used. Another factor that contributes to durability is the combination of a large side surface area, such as about 144 $in^2$ for a 6×6×24 inch pitching rubber, with a density in the range of about 0.04 to about 0.06 pounds per cubic inch. Density in this context is referring to the weight or mass of the object divided by the volume of the overall shape (if the pitching rubber has ends with voids, this is not the actual volume of the rubber), ie, 6×6×24 $in^3$, regardless of whether the ends have voids. Likewise, for hollow-core pitching rubbers, the volume (for purposes of determining density of the product) is dictated by the overall dimensions of the product. Thus, if the same rubber material is used for a hollow core pitching rubber and a solid pitching rubber, it follows that the two overall products will have different densities, in that the overall configuration of the product is used as the volume rather than only the actual volume of the rubber material itself. When referring to density of a material in the context of this specification, the actual weight and actual volume of the material are used.

The pitching rubber of the present invention may be formed of any elastic composition currently in use, although other suitable compositions could alternatively be employed. In some embodiments, the material may be a hard rubber. A person of ordinary skill in the art, with the benefit of this disclosure, would know the type of material to use. Such material must have sufficient integrity to withstand wear associated with a baseball or softball game. Representative polymers can include Buna-N (butadiene acrylonitrile), Neoprene (polychloroprene), EPR (ethylene propylene), silicone (polysiloxane), such as PENTASIL, fluorosilicone, fluro elastomers (fluorinated hydrocarbons), natural (cis-1-4 polyisoprene) or synthetic rubber, SBR (styrene butadiene), urethanes and polyurethanes (polyester/polyether urethane), butyl (isobutylene Isoprene), hydrin (epichlorohydrin), and hypalon (chlorosulfonated polyethylene), extruded polystyrene/ethylene-propylene-diene rubber blends to name a few. The rubber can be vulcanized if desired. The material of the pitching rubber can be any polymeric material. Preferred materials are endowed with the properties of flexibility and extensibility, meaning that upon the application of force, the molecules of the polymers straighten out in the direction in which they are being pulled; on release from being extended, they spontaneously recover their normal, random arrangements.

Physical characteristics of the pitching rubber material can include a Shore A hardness in the range of about 20 to about 100. Preferred embodiments can have a hardness ranging from about 30-90, or about 25-40, or about 35-95, or about 50-80, or about 60-90. The material can have a tensile strength ranging from about 200-6,000 PSI, such as from about 500-2,500 PSI, or from about 1,000-3,000 PSI, or from about 200-800 PSI, or from about 1,500-2,000 PSI, or from about 2,000-3,500 PSI. Another characteristic of the composition of the pitching rubber can include a maximum elongation (extensibility) of up to 750%, such as from about 450-600%. For some applications the melting temperature or glass transition temperature of the pitching rubber material may be important, especially in warm to hot climates or seasons. A melting temperature of about 25 or a glass transition temperature of about −70 is preferred. Materials resistant to radiation or ultraviolet radiation are also desirable. Materials capable of retaining shape throughout ranges of about −60 to about 315 degrees C. are preferred. Even further, the pitching rubber material can have good to excellent resilience (rebound). Other characteristics can include good tear and abrasion properties and good resistance to heat. In addition, the pitching rubber typically retains good flexibility at low temperatures, while having good impact strength. Good compressive strength, impact strength, and resistance to Euler buckling are also desirable. A compressive strength of about 30 MPa is preferred. In designing testing experiments to determine if a material is acceptable for use in the invention, ASTM standards and tests should be used. For example, ASTM D-572 can be used to measure for rubber deterioration, or ASTM D-412 can be used for tensile strength, or ASTM D-624 for tear strength, or ASTM D-2240 for Shore hardness, or ASTM D-1817-05 can be used for density, or degradation in compression tests can be performed using ASTM D-623-07, while ASTM D-395, such as ASTM D395-03 (2008), can be used to measure compression set.

Embodiments of the invention can comprise material having any of the following characteristics, combinations of characteristics, or sets of characteristics: (i) density of about 1.12-1.19 g/$cm^3$, Shore A hardness of about 12-90, tensile strength of about 8-11.8 MPa, elongation at break of about 300-950%, tear strength of about 17-26 N/mm, rebound elasticity of about 45-60%, and compression set of about 25-55%; (ii) density of about 1.17-1.19 g/$cm^3$, Shore A hardness of about 60-75, tensile strength of about 10-11 MPa, elongation at break of about 450-500%, and tear strength of about 27-34 N/mm; (iii) density of about 1.13-1.17 g/$cm^3$, Shore A hardness of about 30-70, tensile strength of about 9-11 MPa, elongation at break of about 550-1,000%, tear strength of about 35-40 N/mm, rebound elasticity of about 45-55%, and compression set of about 25-45%; and (iv) density of about 1.13-1.16 g/$cm^3$, Shore A hardness of about 40-60, tensile strength of about 9-11 MPa, elongation at break of about 500-800%, tear strength of about 21-27 N/mm, rebound elasticity of about 42-47%, and compression set of about 15-35%.

In preferred embodiments of a 6×6×24 inch pitching rubber, the weight range of the formed pitching rubber may be about 40 pounds to about 50 pounds and the density range may be from about 0.04 pounds per cubic inch to about 0.06 pounds per cubic inch. Lighter overall products are preferred, however, the overall weight of the final product will be determined by the type of material used and as a general rule for stronger more dense rubber material, or products incorporating more material into the configuration, the overall weight of the product will be higher. In some embodiments, pitching rubbers weighing about 20-30 pounds are possible with appropriate adjustments.

Referring now to the Figures, and in particular to FIG. 1, shown is one embodiment of a pitching rubber of the present invention. As shown, the four sided, solid pitching rubber may have carved out ends. The carved out ends allow the pitching rubber to receive dirt, clay, or cement and stabilize the structure in the ground. The ends may be recessed by about 1 to about 2 inches from each end, such as about 1.5 inches. In some embodiments, the angle for the carve outs may be about 45 degrees. The carved out ends can be cylindrical in shape or conical. In such embodiments, the remaining portion of the pitching rubber constitutes a solid block with a substantially uniform density throughout the material. Preferred embodiments have cut out ends that together contribute to a void of no more than about 15% of the volume of a three-dimensional shape defined by the outer dimensions of the block. In this manner, the block would exhibit a good compressive strength upon pressure applied to both elongated ends or to two of the elongated sides of the block. A pitching rubber with a surface area (referring to the entire rubber surface with or without voided ends) of about 648 $in^2$ to about 744 $in^2$ is preferred, for example, which could have four sides measuring 6×24 inches and two elongated ends having a 3 inch recess, which is 4 inches square, thus leaving a 1 inch framed edge around the recess at the elongated end.

Figure 2:
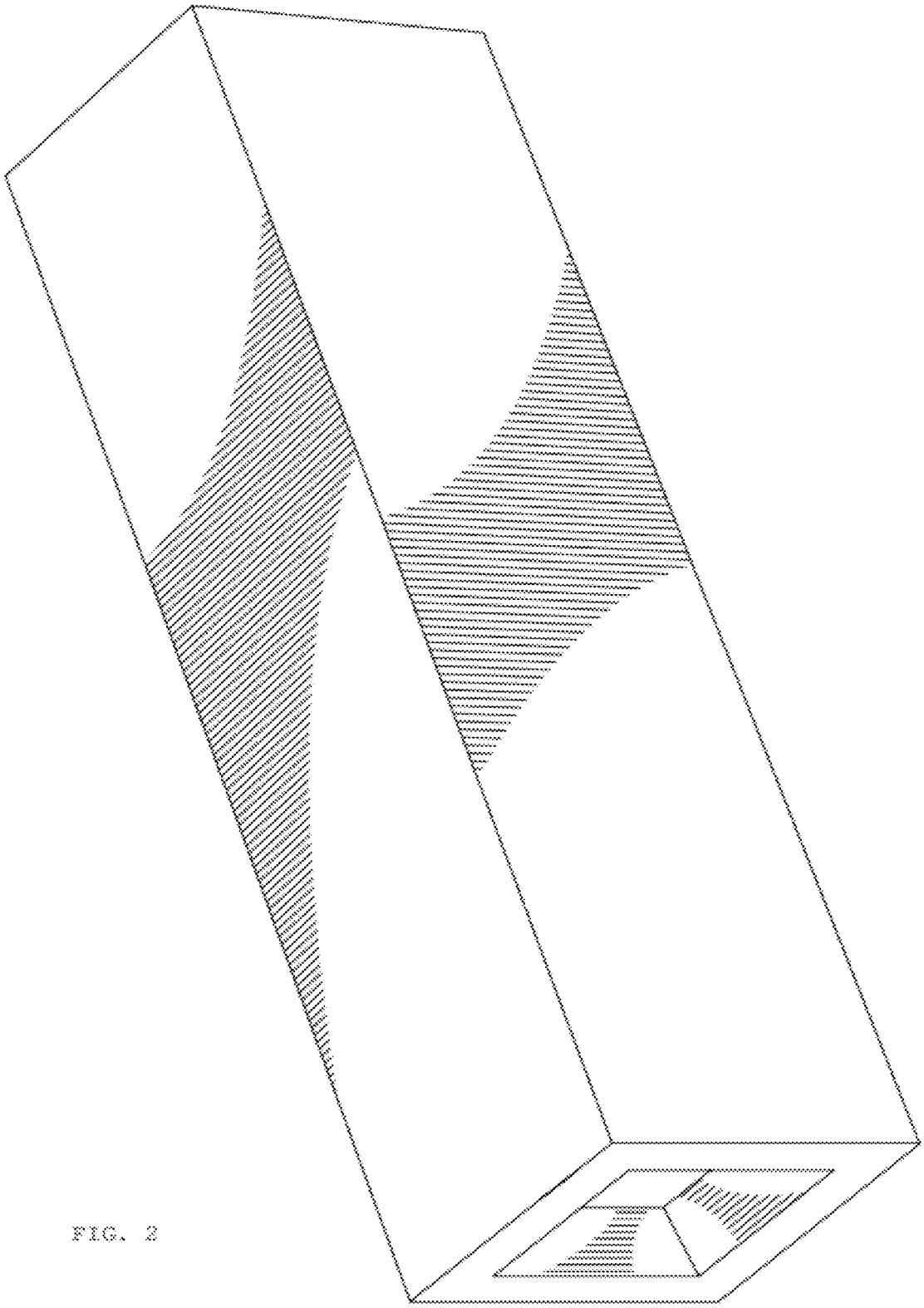
FIG. 2 represents a side perspective view of another pitching rubber constructed in accordance with the present invention.

FIG. 2 is a pitching rubber of the invention with square-shaped carved out ends. What is meant by carved out or cut out is that there is a void, not necessarily that the material is actually formed in the shape of a block and then material is removed, although this could be one method of manufacturing the pitching rubber according to embodiments of the invention. If a 1 inch ledge remains around the perimeter of the elongated ends and the depth into the block of the void is 1 inch, then the voids of the block constitute only about 3% of the volume of the block. Further for example, if a 2 inch ledge remains and the void is 1 inch deep, then about 1% of the volume of the block is void. Any void from about 0% to about 20% would be acceptable in accordance with the invention. Both ends of the pitching rubber do not have to have voids, just one might suffice for certain applications. Even further, it is not critical that either elongated end of the block have a void, and this embodiment may be preferred for some applications as well.

Figure 3A:
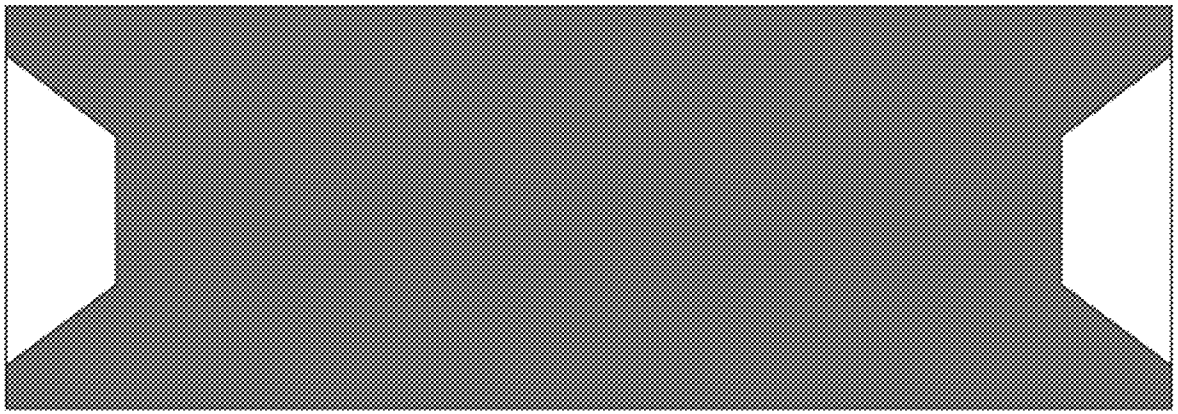
FIGS. 3A and 3B respectively provide a schematic planar side view and end view of a pitching rubber according to the invention.
Figure 3B:
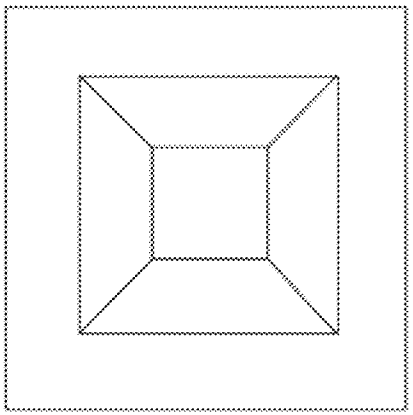

FIGS. 3A and 3B provide planar views of respectively a side and elongated end of a pitching rubber according to an embodiment of the present invention. As shown in FIGS. 3A-B, in certain preferred embodiments, the pitching rubber is a solid rubber material which is 6 inches wide, 6 inches high, and 24 inches long. Each elongated end comprises a recess of about 2 inches into the interior of the block. An indent angle of about 45 degrees is preferred especially where injection molding or thermosetting are involved to ensure that the pitching rubber will be easily removable from the mold. In other embodiments, or under other manufacturing conditions, such as carving out the material on the elongated ends the sides of the recesses may be at a 90 degree angle relative to the surface of the elongated end (remaining ledge). Yet other embodiments may comprise cuts of greater than 90 degrees into the block to provide counter resistance from the ground when earth is impacted into the recesses. Indeed, any measurements which provide the appropriate stability for the pitching rubber in a desired application may be used. The measurements disclosed herein are measured from the center of the core.

Figure 4A:
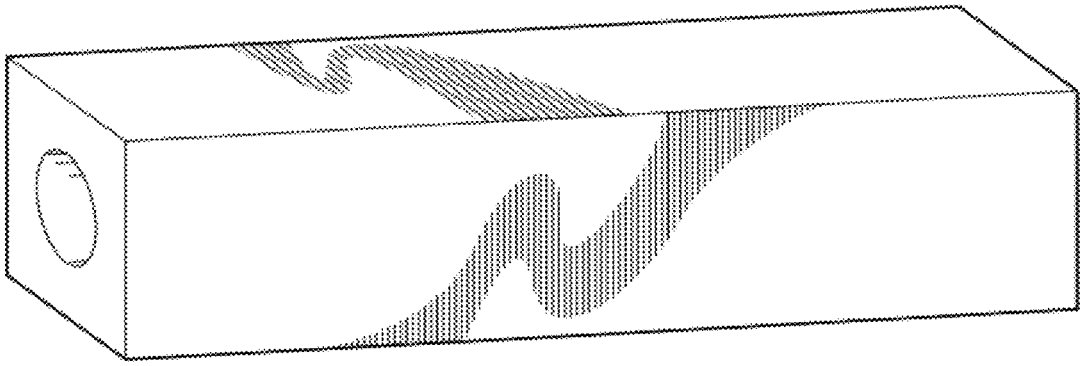
FIGS. 4A and 4B respectively provide a schematic side perspective view and a planar side view of a pitching rubber according to the invention.
Figure 4B:
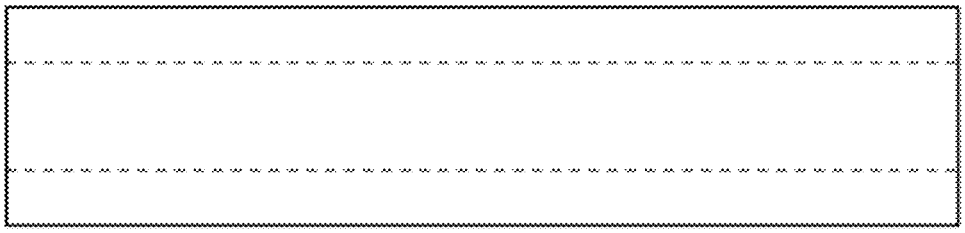

FIGS. 4A and 4B provide respectively a perspective view and a planar view of a preferred embodiment of the invention. As shown in FIGS. 4A-B, the pitching rubber can have a hollow core configuration. In embodiments, and as shown, the pitching rubber can have overall dimensions of about 6×6×24 inches and comprise a hollow core having a diameter of no more than about 3 in. This provides a pitching rubber with a substantial amount of rubber material below each 6×24 in. face of the pitching rubber to provide strength and resistance to buckling when under pressure, especially during use. The hollow interior can be larger, however, stronger or denser rubber materials may be needed to impart the same durability characteristics to the pitching rubber having a smaller core. Current pitching rubbers with hollow cores typically have a larger diameter core and are made of a rubber that does not resist buckling. Accordingly, in contrast to embodiments of the present invention, existing hollow-core pitching rubbers require an aluminum or PVC pipe inserted into the core to provide greater stability. Preferably, the rubber material of embodiments, can be EPDM 75 (a sulfur cured terpolymer of ethylene, propylene and diene), or Neoprene, or polybutadiene or butyl, with a Shore A hardness of about 75+/−5, a minimum tensile strength of about 10 MPA, and a minimum ultimate elongation (ASTM D412) of 300%. Especially preferred pitching rubber embodiments may have an overall 6×6×24 in. configuration, with a 3-in. diameter core, and comprise EPDM 75 rubber having a Shore A hardness of about 73, a tensile strength of about 11 MPA, and an ultimate elongation of about 450%.

Another embodiment of the present invention provides an all-in-one method of making an improved pitching rubber comprising: creating a solid mold, filling the mold with block material, allowing the material to cool, painting each of the sides and testing each of the sides to provide an improved pitching rubber. The sides are tested to ensure that all sides are level and even. The solid mold would have the same dimensions as those discussed above and desired for the pitching rubber.

The present invention has been described with reference to particular embodiments having various features. It will be apparent to those skilled in the art that various modifications and variations can be made in the practice of the present invention without departing from the scope or spirit of the invention. One skilled in the art will recognize that these features may be used singularly or in any combination based on the requirements and specifications of a given application or design. Other embodiments of the invention will be apparent to those skilled in the art from consideration of the specification and practice of the invention. It is intended that the specification and examples be considered as exemplary in nature and that variations that do not depart from the essence of the invention are intended to be within the scope of the invention.

The invention claimed is:

1. A pitching rubber comprising:

a pitching rubber material comprising a solid rubber body having a hollow core lengthwise through a rectangular block;

wherein the hollow core has a circular boundary with a width or diameter of 50% or less of block width;

and wherein the pitching rubber material has a Shore A hardness of about 70-95 and extends to the circular boundary of the hollow core.

2. The pitching rubber of claim 1, wherein the rubber comprises cis-1,4 polyisoprene and the pitching rubber material has a Shore A hardness of about 80-90.

3. The pitching rubber of claim 1, wherein the rectangular block has a width, height, and length of respectively about 6×6×24 inches and the hollow core has a diameter of 3 inches.

4. The pitching rubber of claim 1, wherein the rectangular block has a width, height, and length of respectively about 4×4×18 inches and the hollow core has a diameter of 2 inches.

* * * * *